United States Patent [19]

Bethune et al.

[11] Patent Number: 4,788,757

[45] Date of Patent: Dec. 6, 1988

[54] CASKET ASSEMBLY

[76] Inventors: William Bethune, 32945 N. River Rd., Mt. Clemens, Mich. 48045; Steven J. Pikor, 3059 Serra Dr., Sterling Heights, Mich. 48077; Peter C. Bertleson, 30325 Ponds View Dr., Franklin, Mich. 48025; Bernard E. LePage, 1201 Creek View Ct., Rochester, Mich. 48063

[21] Appl. No.: 821,167

[22] Filed: Jan. 27, 1986

Related U.S. Application Data

[63] Continuation-in-part of Ser. No. 702,549, Feb. 19, 1985, abandoned.

[51] Int. Cl.[4] ..... A61G 17/00

[52] U.S. Cl. ..... 27/2; 27/4; 27/12; 27/35

[58] Field of Search ..... 27/12, 35, 2, 19, 27, 27/1–7

[56] References Cited

U.S. PATENT DOCUMENTS

| | | | |
|---|---|---|---|
| 1,018,853 | 2/1912 | Tucker | 27/12 |
| 1,254,742 | 1/1918 | Svanda | 27/12 |
| 1,401,037 | 12/1921 | Bradley | 27/2 |
| 1,917,152 | 7/1933 | Phelps | 27/12 |
| 2,092,697 | 9/1937 | Gramelspacher | 27/2 |
| 2,159,144 | 5/1939 | Fletcher | 27/35 |
| 2,213,506 | 9/1940 | Thoresen | 27/10 |
| 2,230,433 | 2/1941 | Pinto | 27/12 |
| 2,735,157 | 2/1956 | Hotchkiss et al. | 27/12 |
| 2,759,239 | 8/1956 | Snyder | 27/27 |
| 2,888,732 | 6/1959 | Nelson | 27/12 |
| 3,065,516 | 11/1962 | Dower | 27/12 |
| 3,613,189 | 10/1971 | Kirby | 27/35 |
| 3,810,282 | 5/1974 | Doggett | 27/35 |
| 3,815,185 | 6/1974 | Owens | 27/19 X |
| 4,177,543 | 12/1979 | Angermann | 27/35 |
| 4,237,590 | 12/1980 | Work | 27/2 |
| 4,267,623 | 5/1981 | Christian | 27/2 |

FOREIGN PATENT DOCUMENTS

| | | | |
|---|---|---|---|
| 1331492 | 6/1963 | France | 27/7 |
| 13033 | of 1900 | United Kingdom | 27/12 |

*Primary Examiner*—James R. Feyrer
*Attorney, Agent, or Firm*—Krass & Young

[57] ABSTRACT

A casket assembly of the casket surround type in which the casket surround includes a movable floor and an adjustment mechanism for raising and lowering the floor or tilting the floor. The floor is raised during the viewing process to provide an optimal viewing position and is lowered following the viewing process so that the vault can be sealed and the sealed vault may be transported within the casket surround to the burial site. The casket surround comprises a simple core structure to which the various components of exterior ornamentation are removably secured so that damaged components may be readily and selectively removed and replaced. One end wall of the casket surround is hinged adjacent its lower edge so that it may be pivoted to a lowered, open position to facilitate insertion or removal of the vault from the casket surround.

6 Claims, 7 Drawing Sheets

FIG.10
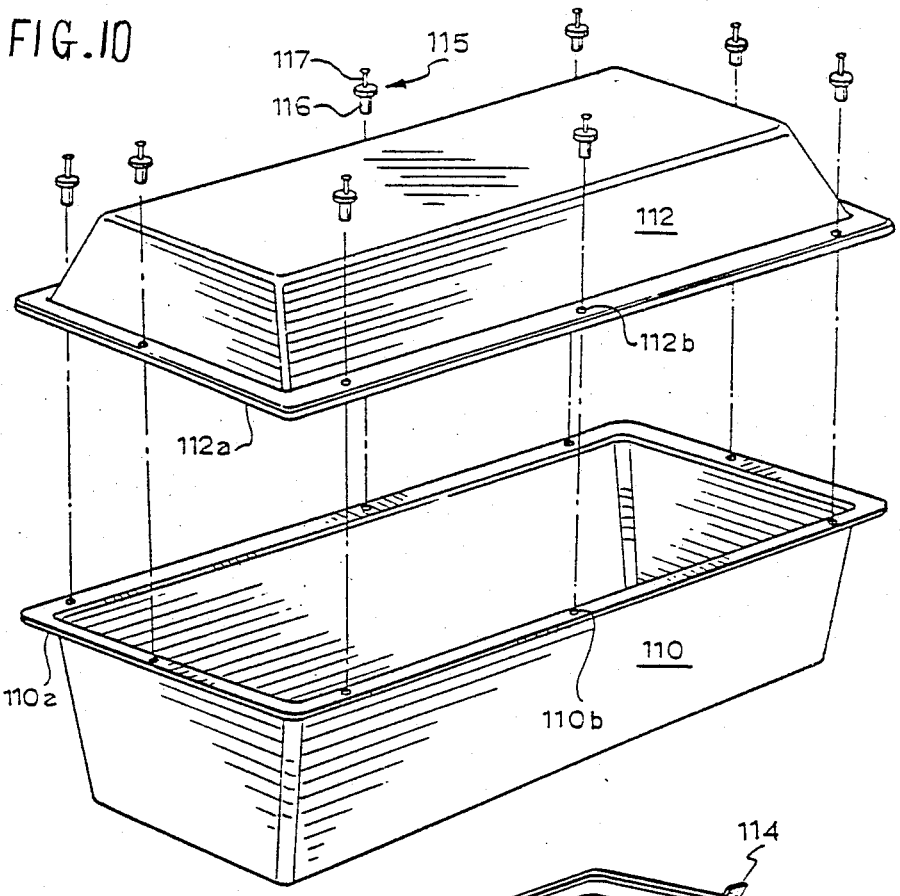
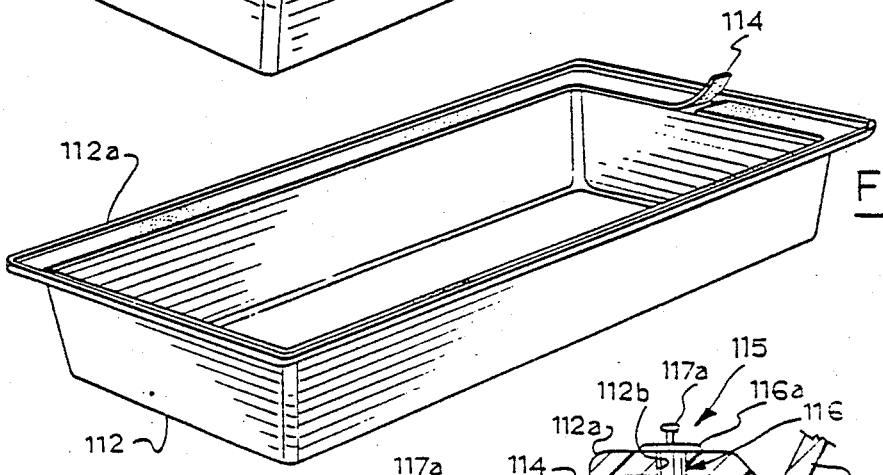
FIG.13
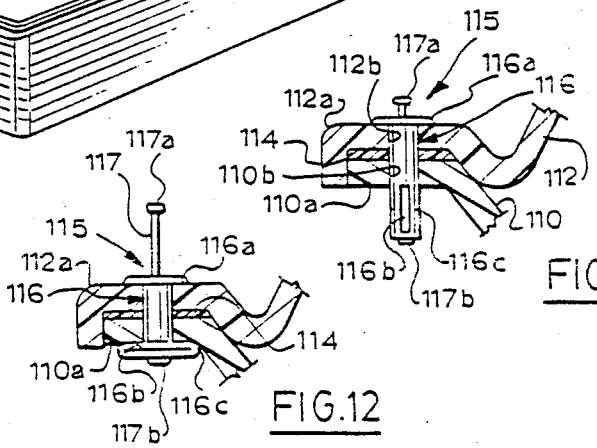
FIG.11
FIG.12

CASKET ASSEMBLY

RELATED APPLICATION

This application is a continuation-in-part of U.S. Patent application Ser. No. 702,549 filed Feb. 19, 1985, now abandoned.

FIELD OF THE INVENTION

This application relates to casket assemblies and more particularly to casket assemblies of the type including a casket surround and a separate vault.

BACKGROUND OF THE INVENTION

Death related purchases are usually very significant and often may constitute the third largest purchase made by a family next to the purchase of a home and the purchase of a car. Many attempts have been made in the past to reduce the expense of the bereavement and burial process without detracting from the dignity of the process. One such attempt has involved the use of a so-called casket surround which comprises a very elaborate casket which surrounds a separate relatively inexpensive fiberglass vault. During the viewing process, the corpse is placed in the base of the vault and the vault is positioned within the casket surround. The casket surround is removed before burial so that only the relatively inexpensive fiberglass vault is buried and the relatively expensive casket surround may be used over and over again. This arrangement preserves the dignity of the bereavement and burial process and has resulted in a significant reduction in the total cost involved. However, whereas the casket surround system has proven to be very successful in reducing costs, the presently available casket surround assemblies have certain disadvantages. Specifically, since the construction of the prior art surround systems do not allow the lid of the casket surround to be closed after the lid of the vault has been sealed to the base of the vault, either the casket surround must be left at the funeral home with the result that the remainder of the service is conducted with the relatively unattractive fiberglass vault or, if the surround is taken to the cemetery, the final sealing operation, where the lid of the vault is sealed to the base of the vault, must be performed at the cemetery where weather conditions may be unsatisfactory and where discreet control of the mourners may be much more difficult than in the controlled environment of the funeral home. Further, even though the prior art casket surround systems have reduced costs considerably, the casket surround itself continues itself to be a very high initial cost item and a very high maintenance item.

BRIEF SUMMARY OF THE INVENTION

This invention is directed to the provision of a casket assembly of the casket surround type wherein the complete vault assembly may be contained within the closed casket surround so that the casket surround and vault may be conveniently transported to the burial site.

This invention is further directed to the provision of a casket assembly of the casket surround type wherein the construction of the casket surround is extremely simplified to minimize initial cost and maintenance costs.

According to an important feature of the invention, the casket surround includes a movable floor assembly and an adjustment mechanism for moving the floor assembly between raised and lowered positions within the casket surround. With this arrangement, the floor assembly of the casket surround may be raised during the viewing process so that the corpse resting in the base of the vault may be precisely and selectively positioned to facilitate the viewing, whereafter the floor assembly of the casket surround may be lowered to allow the lid of the vault to be sealed to the bottom of the vault whereafter the lid of the casket surround may be closed.

According to a further feature of the invention, one of the end walls of the casket surround may be readily opened so that the sealed vault may be readily inserted into and removed from the casket surround through the opened end wall.

According to a further feature of the invention, the casket surround comprises a basic, simple core structure and the ornamental appearance aspects of the casket are provided by separate components which are removably secured to the basic core structure so that they may be readily and individually replaced when damaged or when it is desired to provide a different exterior ornate appearance for the casket surround.

BRIEF DESCRIPTION OF THE DRAWINGS

FIG. 10 is an exploded perspective view showing the manner in which the vault is sealed;

FIGS. 11 and 12 are fragmentary detail views further showing the manner in which the vault is sealed;

FIG. 13 is a bottom perspective view of the lid of the vault of the invention;

DETAILED DESCRIPTION OF THE PREFERRED EMBODIMENT

Figure 1:
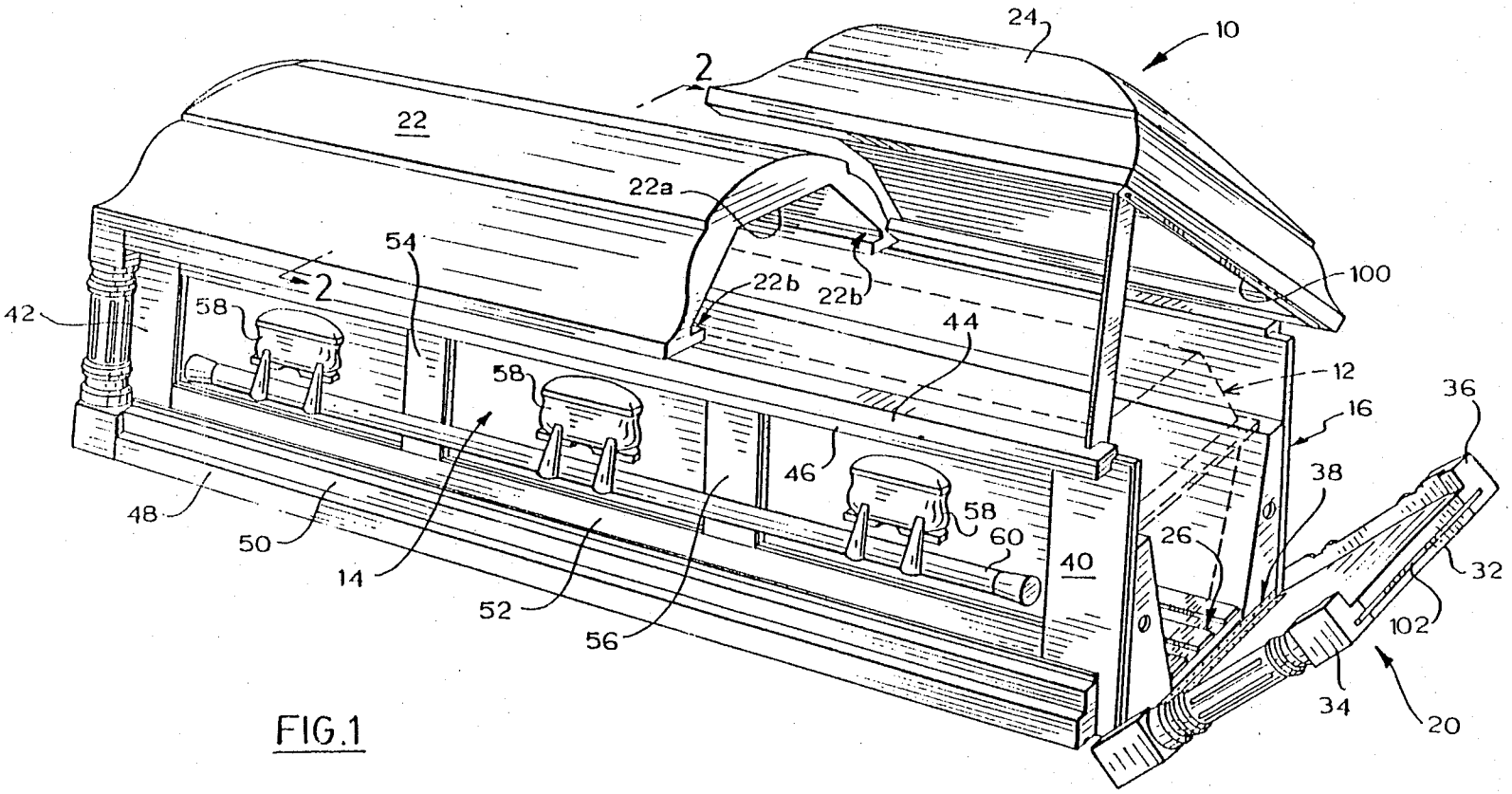
FIG. 1 is a perspective view of the total casket assembly according to the invention.
Figure 3:
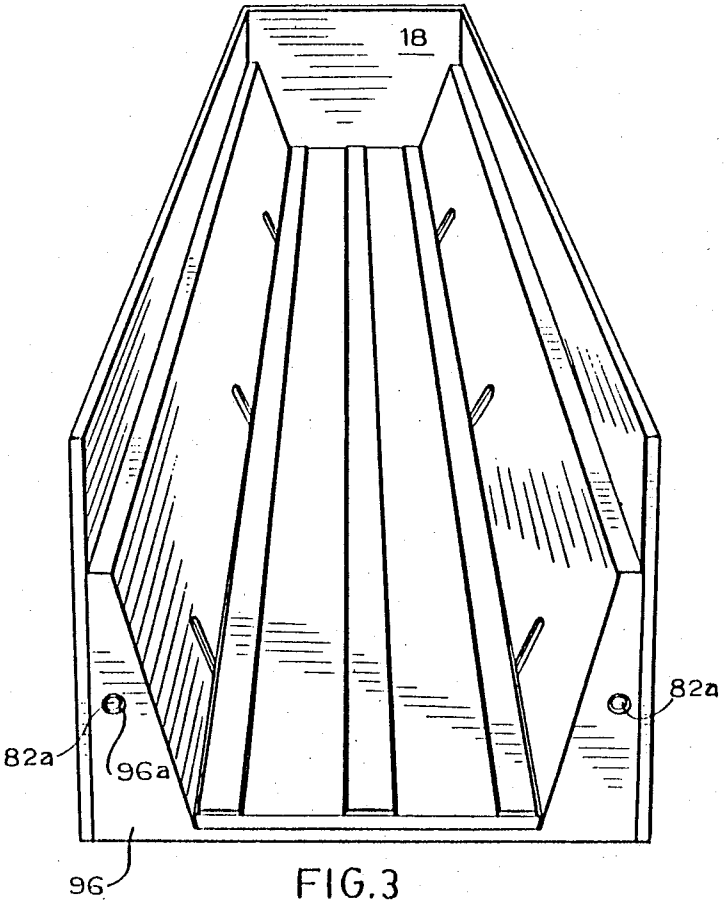
FIG. 3 is a perspective view of the core structure of the casket surround of the invention.

The casket assembly of the invention, broadly considered, comprises a casket surround 10 and a vault 12.

Casket surround 10 includes sidewalls 14 and 16; end panels 18 and 20; a left lid 22; a right lid 24; a bottom panel 26; a movable floor 28; and a pair of adjustment mechanisms seen generally at 30.

Side panels 14 and 16, end panels 18 and 20, and bottom panel 26 are formed of wood laminates.

End panel 20 is a composite structure including a central panel 32 and a pair of ornamental end pillars 34 and 36 removably and replaceably secured by countersunk screws to the opposite vertical side edges of the central panel 32. The lower edge of end panel 20 is secured to the adjacent end edge of bottom panel 26 by a piano hinge 38 so that the end panel 20 may be moved pivotally about its lower edge from a raised position in which it closes the casket surround and a lowered position in which it allows the vault 12 to be inserted into or removed from the casket surround. Each of the ornamental end pillars 34 and 36 have an L-configuration in cross section so that the pillars extend around the side of the casket surround when the end panel is in its raised or closed position. The construction of end panel 18 is similar to that described with respect to end panel 20 with the exception that end panel 18 is permanently secured to the other panels of the casket surround.

A plurality of exterior ornamentation components are removably secured to the core structure of the casket surround so that they may be readily and selectively replaced in the event that they are damaged or in the event that a different exterior ornamentation is desired. For example, and as best seen in FIG. 1, vertical ornamentation panels 40 and 42 are removably secured to the end portions of side panel 14 as by countersunk screws or the like; longitudinal ornamental molding 44 of L-shaped cross section is secured to the upper edge of side panel 14; a longitudinal ornamental molding 46 is secured to side panel 14 immediately below molding 44; a longitudinal molding 48 is removably secured to side panel 14 along the bottom edge of side panel 14; a further longitudinal ornamental molding 50 is secured to side panel 14 immediately above molding 48; a further longitudinal panel 52 is secured to side panel 14 immediately above molding 50; vertical panels 54 and 56 are secured to side panel 14 to extend between panels 52 and 46 at longitudinally spaced locations along panel 14; and handles 58, supporting a carrying rail 60, are removably secured to side panel 14 at longitudinally spaced locations along the side panel. Identical ornamentation is secured to the other side panel 16 and compatible ornamentation is removably secured to rear panel 16 and to end panels 18 and 20. The various removably secured panels and moldings preferably are formed of woodgrain formica and the removably secured handles preferably are formed of wood.

Movable floor 28 may be formed of a relatively inexpensive base structure with a plurality of nylon skids **28*a* secured to the upper face of the floor at transversely spaced locations thereacross. Transversely extending hemispherical grooves 28*b* are provided in the bottom surface of floor 28** at longitudinally spaced locations therealong.

Adjustment mechanisms 30 are adapted to raise, lower, or tilt floor 28. Each adjustment mechanism 30 includes an adjustment assembly 62 and an actuating assembly 64. Each adjustment assembly 62 includes a plurality of pulleys 84 and a plurality of cables 66. Pulleys 84 are secured to generally triangular braces 68 secured to the respective side panel and to bottom panel 26 at longitudinally spaced locations along the side panel. Holes **68*a* in the appropriate side panels 68 allows free passage of cables 66. The lower ends of cables 66, following passage over the respective pulley 64, are secured by lock nuts 70 to the end of a respective lift bar 72 positioned in a respective groove 28*b* in the bottom of floor 28. Lower support members 74 extend between selected braces 68 to reinforce the braces at their lower ends and upper support members 76 and 78** are positioned between the brace members to provide structural rigidity for the upper ends of the brace members.

Each actuating assembly 64 includes a crank arm 80 and a screw bolt 82. The free ends of cable 66 are secured to the upper end of crank arm 80 by a bolt assembly 84 and the lower end of crank arm 80 is pivotally mounted to the adjacent side panel of the casket surround by a pivot bolt assembly 86. Screw bolt 82 is threadably engaged at its inner end with a nut 88 fixedly secured to crank arm 80. The outer end of bolt 82 is journalled in brace **68*a* with the head 82*a* of the bolt positioned in a suitable opening in the outermost brace 68*b* so that the head may be conveniently accessed by a suitable crank tool 90 when end panel 20 is moved to its opened position. It will be seen that rotation of screw 82 by cranking tool 90 will pivot crank arm 80 about pivot point 86 so that cables 66 are moved longitudinally to raise or lower the respective lift bars 72 and thereby raise or lower floor 28**. It will further be seen that similar movement imparted to the adjustment mechanisms at both sides of the floor will result in a uniform or translatory up or down movement of the floor and that dissimilar movement applied to the two adjustment mechanisms will result in tilting movement of the floor about either of its longitudinal edges.

In the finished casket surround, a fomica panel 92 covers the exposed vertical edges of braces 68 with slots **92*a* allowing vertical movement of lift bars 72 and split rubber pads 93 secured to the inner face of panel 92 adjacent each slot 92*a* sealingly engaging the bars as they are moved up and down. A further fomica panel 94 covers the top edges of braces 68 as well as reinforcing members 76,78, and a U-shaped fomica panel 96 covers the outer face of end brace 68*b* as well as the outer edge of bottom panel 26. A suitable opening 96*a* in panel 96 allows tool 90 to access the head 82*a* of the screw bolt 82**.

Lids 22 and 24 are hinged at their rear edges to molding 44 and are preferably formed of a suitable wood material.

Lid 22 has a hollowed out interior configuration **22*a* to accommodate the lid of the vault 12 when the casket surround is closed, and is further provided with a peripheral groove 22*b* which extends around three sides of the lid in a U-configuration to slidably and removably receive a finery panel 98, which is positioned over the upper portion of the corpse when lid 22** is raised during the viewing process. This arrangement allows the finery panels to be readily replaced in the event of damage and further allows selective interchange of the panel to provide the desired visual effect so that the same casket surround may, by the use of a plurality of different finery panels, be readily tailored to suit the tastes of a variety of customers.

Lid 24 includes a bar 100 which projects below the lid. In the closed position of end panel 20 and the closed position of lid 24, bar 100 is received in a groove 102 defined in the upper edge of end panel 20 to interlock the the lid and end panel. A prop 104 pivotally secured to lid 24 at 106 is normally held in a stowed position inside the lid by a magnet 108 but may be pivoted downwardly to the position seen in FIG. 1 where it engages the casket surround molding 44 to maintain lid 24 in a raised position for insertion and removable of vault 12.

Vault 12 is preferably formed of a suitable fiberglass material and includes a base 110 and a lid 112. Base 110 includes a continuous peripheral flange 110*a* and lid 112 includes a continuous peripheral flange 112*a*. A tape 114 is adhesively secured to the lower face of lid flange 112*a* and extends around the entire periphery of the lid flange. Tape 114 may, for example, be formed of a polyvinylchloride closed-cell foam material and may have a thickness of ¼ inch and a width of 1½ inches. Lid flange 112*a* has a downwardly opening U-shaped configuration to nestingly and sealingly receive tape 114 and base flange 110*a*.

The casket assembly of the invention is typically delivered to the funeral home with the floor 28 of the casket surround in its lowered position and the base 110 of the vault, with vault lid 112 removed, positioned within the casket surround on the lowered floor. The corpse is loaded into the vault base through the open top of the casket surround and adjustment mechanisms 30 are actuated to raise floor 28 and thereby base 110 to a raised position, seen in dotted lines in FIG. 2, where the upper flange 110*a* of the base is adjacent the upper edge of the casket surround to provide a convenient position for viewing the corpse in the base of the vault. The floor 28 and thereby the vault base 110 may also be selectively tilted about either longitudinal edge of the floor to selectively position the corpse for viewing by dissimilar movement of the actuating mechanisms 30.

Figure 2:
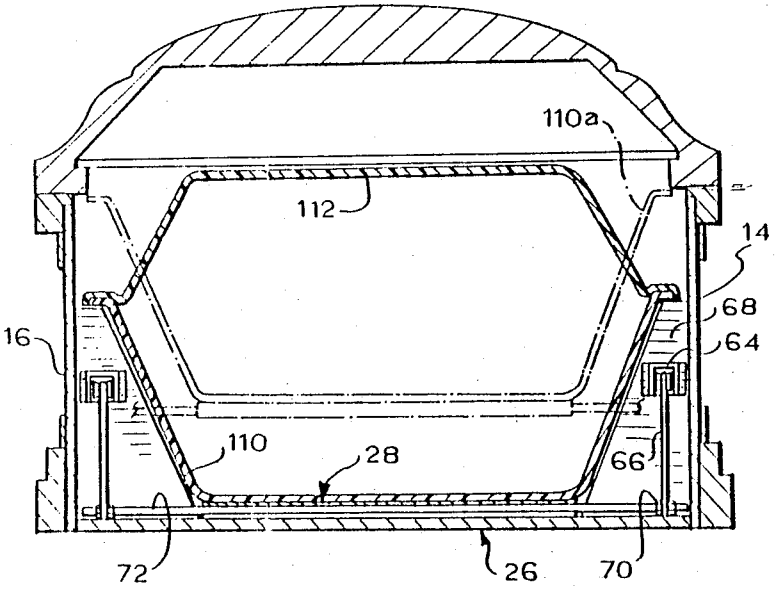
FIG. 2 is a cross sectional view taken on line 2—2 of FIG. 1.
Figure 4:
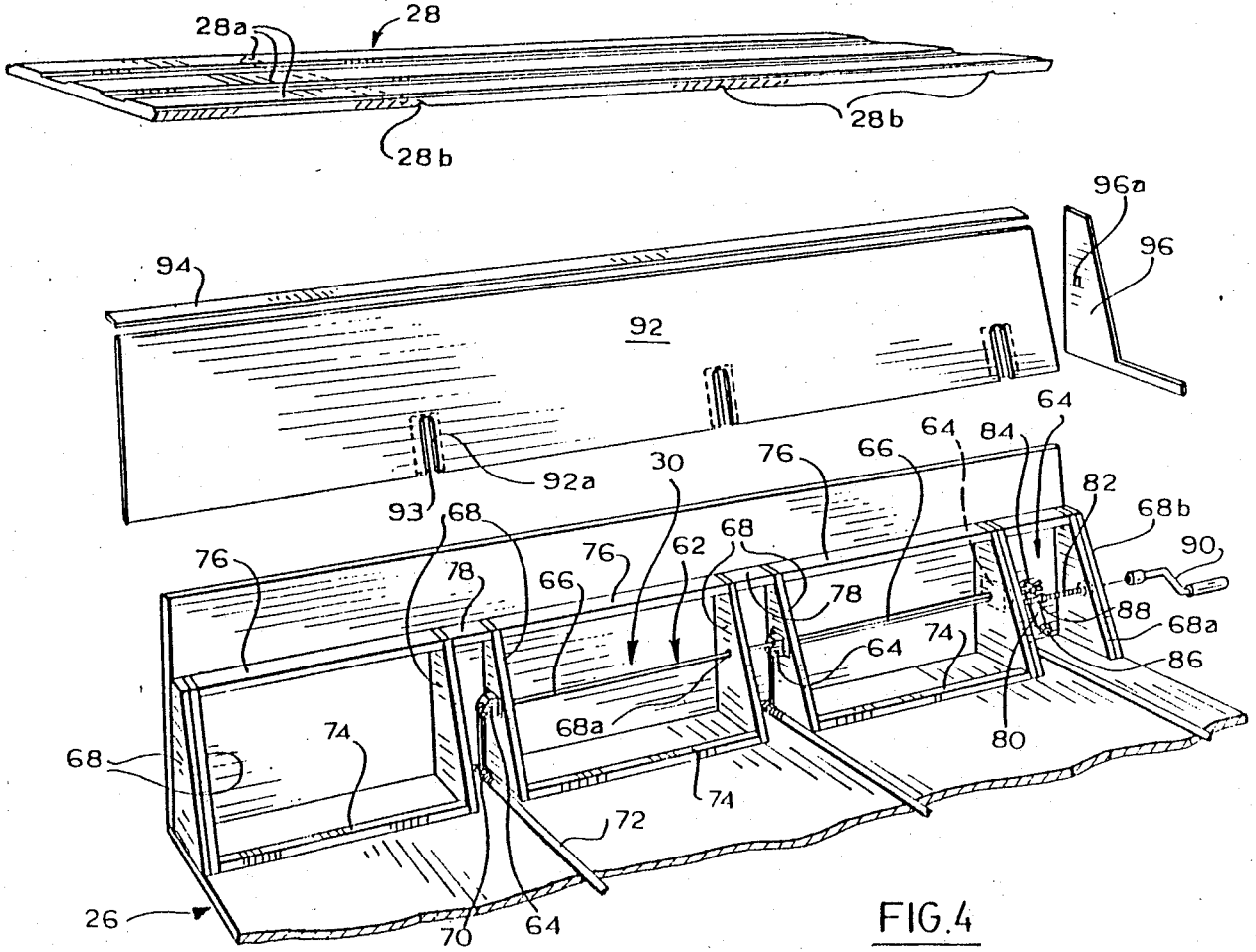
FIG. 4 is perspective fragmentary view showing an adjustment mechanism for use with the invention casket assembly.
Figure 5:
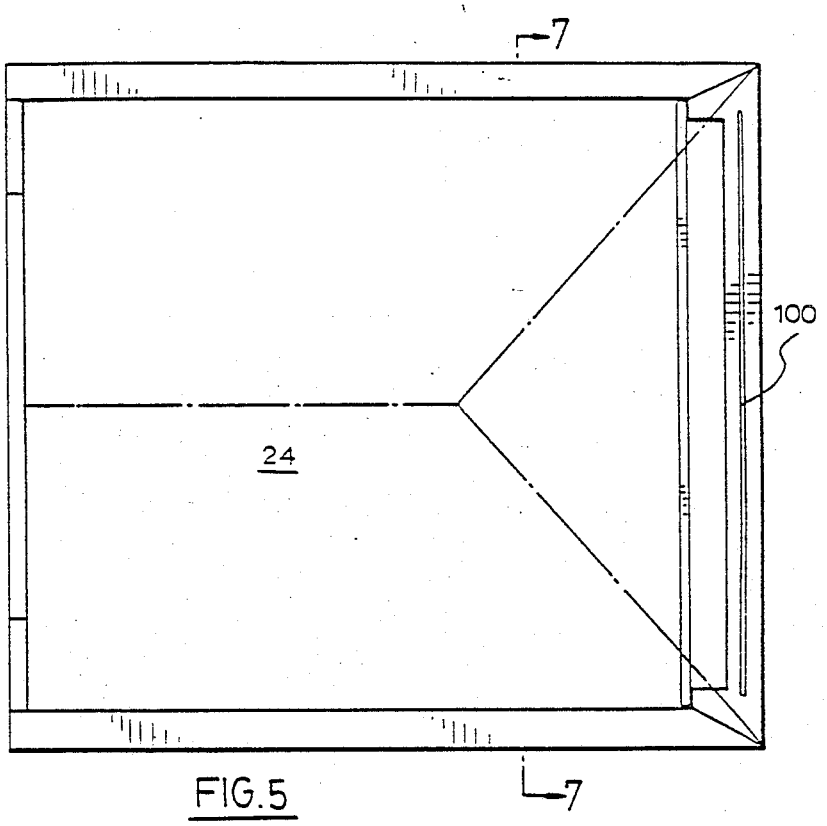
FIGS. 5 and 6 are plan and elevation views respectively of the right half of the lid of the casket surround.
Figure 6:
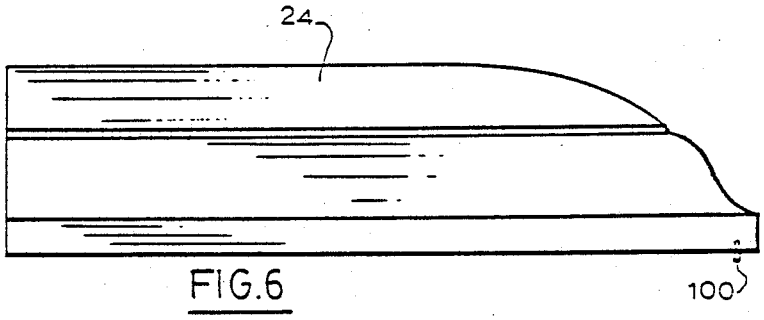
Figure 7:
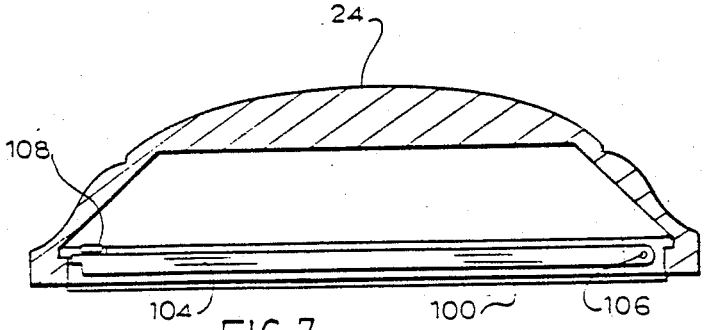
FIG. 7 is a cross sectional view taken on line 7—7 of FIG. 5.
Figure 8:
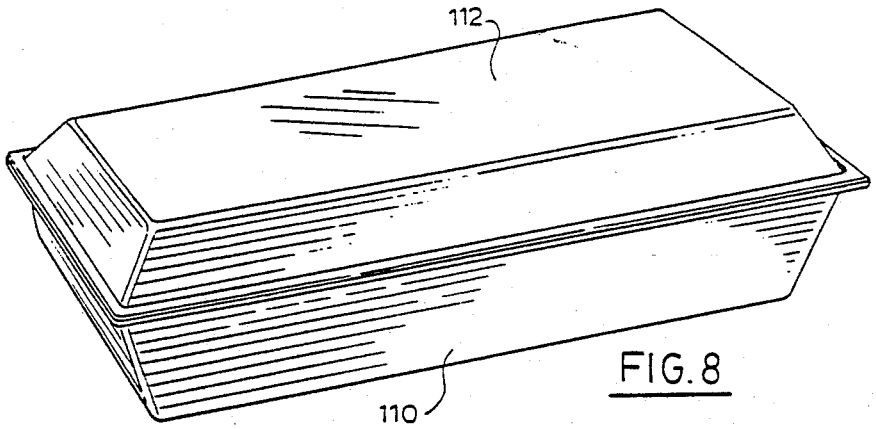
FIGS. 8 and 9 are perspective and cross sectional views, respectively, of the vault of the invention.
Figure 9:
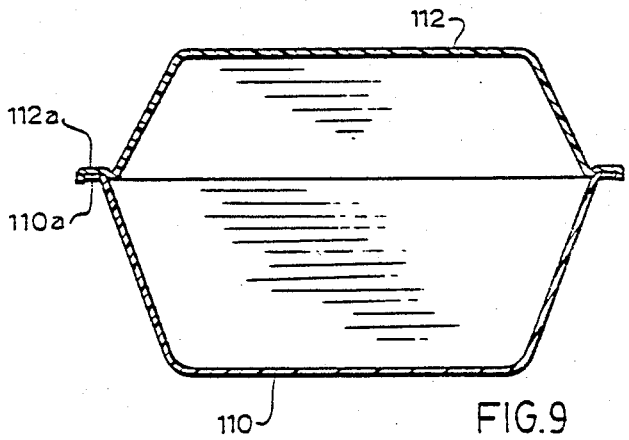

After viewing, which typically takes place in a funeral home, and after the mourners have left for the burial site, actuating mechanisms 30 are actuated to lower floor 28 to the solid line position of FIG. 2, whereafter vault lid 112 is positioned over vault base 110 and permanently sealed to base 110. Sealing is accomplished by positioning lid 112 over base 110 to position tape 114 over and circumferentially around flange 112*a*, and thereafter forcibly passing a plurality of fasteners 115 downwardly through circumferentially spaced holes 112*b* in lid flange 112*a* for passage through tape 114 and subsequent passage through circumferentially spaced holes 110*b* is base flange 110*a*.

Each fastener 115 includes a cylindrical plastic body member 116 and a metal pin member 117. Body member 116 includes a head 116*a* and vertically extending notches 116*b* defining splayable leg portions 116*c*. Metal pin member 117 passes centrally through body member 116 and includes a head 117*a* and a bottom flange 117*b*. After fasteners 115 have been forced downwardly through vertically aligned holes 112*b* and 110*b* and through tape 114 to seat body member head 116*a* against the upper face of flange 112*a*, pin member head 117*a* is grasped by a suitable tool and pin member 117 is forcibly raised to its sealing position of FIG. 12 in which pin flange 117*b* has pulled upwardly on leg portions 116*c* to buckle the leg portions at their prescored knees and splay the leg portions outwardly to form the flange structure 116*d* which coacts with head 116*a* to clamp flanges 112*a* and 110*a* tightly together with tape 114 clamped sealingly between the flanges. The raised, exposed portions of pins 117 are now suitable severed to complete the vault sealing operation, whereafter lids 22 and 24 are lowered to their closed position and the total casket assembly, including the casket surround and the sealed vault, is transported to the burial site.

Alternatively, if a second viewing is desired at the burial site, the unsealed vault may be transported within the casket surround to the burial site whereafter, following the second viewing at the burial site, the vault may be sealed in the manner previously described.

Following the ceremonies at the burial site, and preferably after the mourners have left the burial site, end panel 20 is opened, lid 24 is raised, and the sealed vault is slid out of the casket surround for interment. The casket surround is then returned to the funeral home for use in further funerals.

Figure 14:
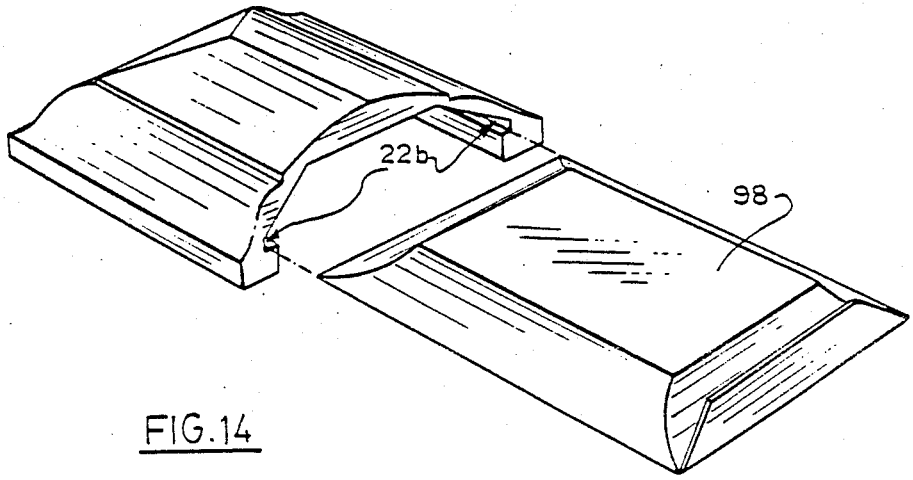
FIG. 14 is a fragmentary perspective view of the left half of the lid of the casket surround showing the manner in which finery may be interchangably inserted into the lid.
Figure 15:
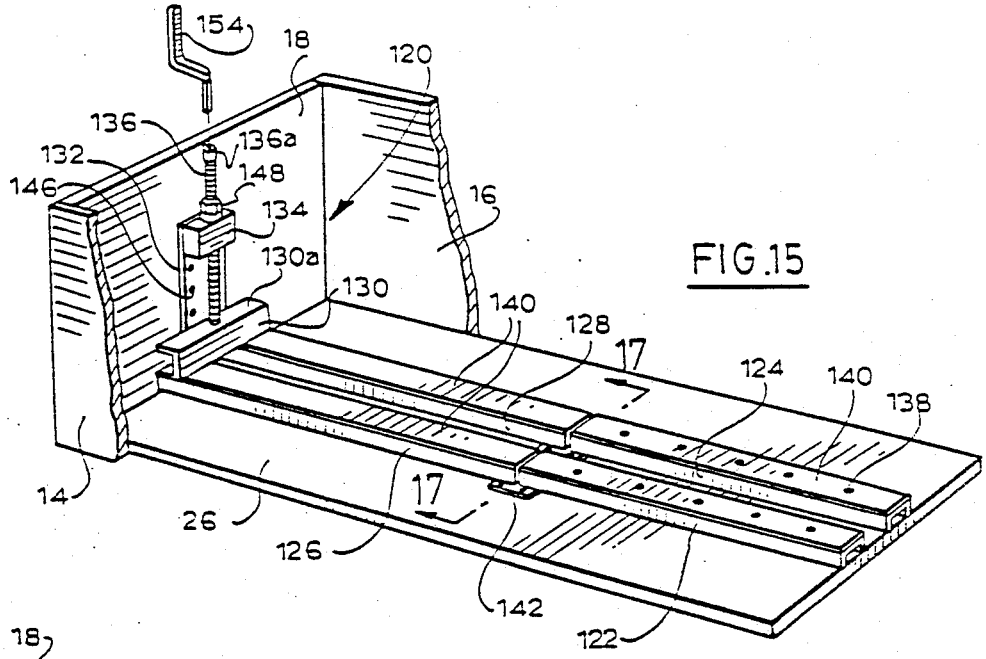
FIG. 15 is a fragmentary perspective view of a modified adjustment mechanism for use with the invention casket assembly.

The modified adjustment mechanism seen at 120 in FIGS. 13–15 includes a first pair of rails 122 and 124, a second pair of rails 126 and 128, a channel member 130, a plate 132, a block 134 and an adjustment screw 136.

Rails 122 and 124 are formed of aluminum channel stock and are fixedly secured in parallel fashion to the floor 26 of the casket surround as by screws 138. Nylon skid strips 140 are adhesively secured to the upper face of rails 122 and 124. Rails 122 and 124 extend from the openable end 20 of the casket surround to a central location along floor 26 where they are fitted over angle irons 142 secured in flush manner in floor 26.

Rails 126 and 128 are positioned on floor 26 in respective longitudinal alignment with rails 122 and 124 and extend from a central location along floor 26 to the closed end 18 of the casket surround. Rails 126 and 128 are formed of aluminum channel stock and nylon skid strips 140 are adhesively secured to the upper face of the rails. The central ends of rails 126 and 128 are slidably fitted over angle irons 142 and the ends of rails 126,128 adjacent the closed end 18 of the casket surround are fixedly secured to channel member 130. An aluminum strip 144 is secured to the underside of each rail 126,128 adjacent the central end of the rail and each strip 144 extends into the open end of the adjacent rail 122,124.

Plate 132 is secured by screws 146 in central upstanding fashion on the inner face of fixed end panel 18 and block 134 is fixedly secured to the upper end of plate 132.

Screw 136 includes a welded nut 148 and passes downwardly though block 134, through an oversize hole 130*a* in the upper flange 130*b* of channel member 130 for threaded engagement with a tapped rod 150 positioned adjacent the underside of flange 130*b*, and through an oversize hole 130*c* in the lower flange 130*d* of channel member 130. Weld nut 148 bears against a thrust bearing 152 secured to the upper face of block 134 and the upper end of screw 136 includes a head portion 136*a* providing a socket for receipt of an Allen wrench.

Figure 16:
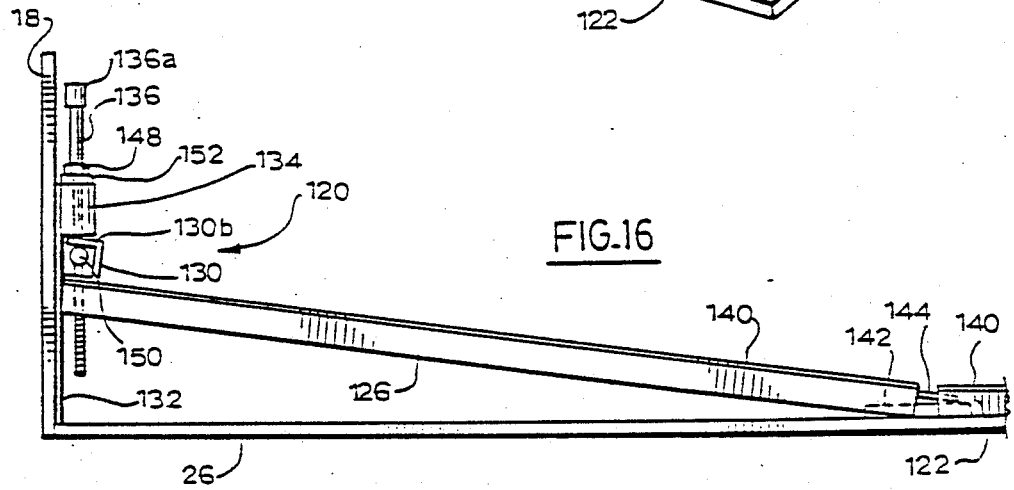
FIG. 16 is a side elevational view of the adjustment mechanism of FIG. 15.
Figure 17:
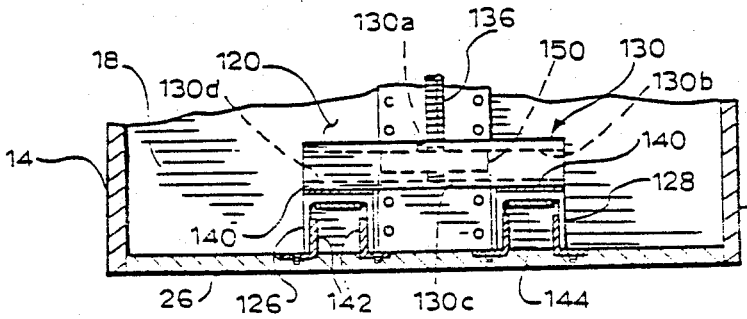
FIG. 17 is a cross-sectional view taken on line 17—17 of FIG. 15.

The casket assembly employing the adjusting mechanism of FIGS. 15–17 is typically delivered to the funeral home with the rails 126 and 128 in their lowered position as seen in FIG. 15 and with the vault base, with the lid removed, positioned within the casket surround on the lowered rail members. The corpse is now loaded through the open top of the casket surround into the vault base and adjustment mechanism 120 is actuated by the use of a suitable Allen wrench tool 154 engaging screw head 136*a* to raise rails 126 and 128 in response to threaded coaction between screw 136 and tapped rod 150 to move the rails to their raised position of FIG. 16 and thereby elevate the head of the vault base 110 to facilitate viewing of the corpse positioned in the vault base. As screw 136 threadably coacts with rod 150, rails 126 and 128 pivot about their central ends and the central ends simultaneously slide along angle irons 142 to create a longitudinal space between the juxtaposed ends of rails 122,124 and 126,128 with this sliding movement being guided by strips 144 guiding in the open ends of rails 122,124. The extreme upward or raised position of rails 126 and 128 is defined by engagement of upper flange 130*b* of channel member 130 with the underface of block 134. After viewing, which typically takes place in a funeral home, and after the mourners have left for the burial site, actuating mechanism 120 is actuated to lower rails 126 and 128 to the position of FIG. 15, whereafter vault lid 112 is positioned over vault base 110 and permanently, sealed to base 110, in the manner previously described, by the use of tape 114 and fasteners 115. Alternatively, and as previously described, vault sealing may take place after a second viewing at the burial site. In either event, following the ceremonies at the burial site, end panel 20 is opened and, with lid 24 is a raised position, the sealed vault is slid out of the open end of the casket surround for interment. The casket surround is then returned to the funeral home for use in further funerals.

The invention casket assembly will be seen to provide several improvements as compared to prior art assemblies of the casket surround type.

Specifically, and by virtue of the moveable floor, the vault may be precisely positioned within the casket surround during the funeral home ceremonies for optimal viewing whereafter the vault may be lowered and sealed and transported within the casket surround to the burial site so that the casket surround, with its ornate and dignified appearance, may be used at the burial site without necessity for performing the final vault sealing operation at the burial site. That is, the casket surround may be used during the entire viewing and burial process and yet the vault sealing operation may be performed in the controlled confines of the funeral home rather than at the burial site.

Further, by virtue of the pivotally mounted end panel, the heavy sealed vault may be readily removed from the casket surround by simply sliding it out of the casket surround through the open end of the casket surround.

The invention casket assembly also provides an extremely inexpensive and readily maintainable casket surround by virtue of the use of separate ornamental components which are removably secured to a simple core structure so that they may be readily and selectively replaced when damaged or when a different exterior ornamental effect is desired. This basic core structure with attached ornamentation significantly reduces both the initial and maintenance cost of the casket surround and thereby significantly reduces the cost of the total burial process.

The provision of a casket surround lid that removably and interchangeably receives a plurality of different finery panels also simplifies and reduces the cost of the burial process since the same casket surround can be used to provide a plurality of different finery effects to please a plurality of different customers.

Further, the unique sealing arrangement between the lid and base of the vault provides superior sealing characteristics as compared to prior art vaults. Specifically, superior vault sealing is achieved by the use of nesting flanges on the base and lid of the vault in combination with the use of an interposed adhesive sealing tape and a plurality of positive fasteners passing grippingly through the base and lid flanges and through the interposed sealing tape.

Whereas a preferred embodiment of the invention has been illustrated and described in detail in will be apparent that various changes may be made in the disclosed embodiment without departing from the scope or spirit of the invention.

We claim:

1. A casket for a corpse comprising:

(A) sidewalls;

(B) end walls;

(C) a lid;

(D) means mounting one of said end walls for movement between a closed position and an open position allowing lengthwise movement of a vault into and out of said casket;

(E) a floor;

(F) fixed rail means extending along said floor between an outboard end positioned adjacent said one end wall to an inboard end positioned at an intermediate location along said floor;

(G) movable rail means extending along said floor between an inboard end adjacent the inboard end of said fixed rail means and an outboard end adjacent said other end wall; and (H) actuator means engaging the outboard end of said movable rail means and operative to raise said outboard end to pivot said movable rail means upwardly about its inboard end.

2. A casket according to claim 1 wherein:

(J) said actuator means includes threaded means carried by said movable rail means adjacent its outboard end and a screw bolt extending vertically adjacent said other end wall for threaded engagement at its lower end with said threaded means and for access at its upper end with a suitable rotating tool.

3. A casket for a corpse comprising:

(A) sidewalls;

(B) end walls;

(C) a lid;

(D) means mounting one of said end walls for movement between a closed position and an open position allowing lengthwise movement of a vault into or out of said casket;

(E) a movable floor;

(F) a plurality of bars extending transversely beneath said floor at longitudinally spaced locations therealong;

(G) a pair of adjustment assemblies respectively positioned within said side walls on opposite longitudinal sides of said movable floor and operative when actuated to selectively raise and lower the respective longitudinal side of said movable floor, each said adjustment assembly including a pulley positioned above one end of each of said bars and a cable secured to each said one bar end and extending upwardly therefrom over a respective pulley and longitudinally to a position adjacent one end wall of said casket; and (H) a pair of actuating assemblies accessible from outside of said casket assembly and each operative when moved to actuate a respective adjustment assembly so that said movable floor may be moved in a translatory manner by similar movement of said actuating assemblies and may be moved in a tilting manner by dissimilar movement of said actuating assemblies, each said actuating assembly including a crank arm positioned within said casket adjacent one end wall for pivotal movement about a transverse axis with the free ends of said cables fixedly secured to said crank arm at a location remote from said pivot axis so that pivotal movement of said crank arm generates longitudinal movement of said cables and vertical movement of said bars and thereby of said movable floor carried thereby.

4. A casket assembly comprising:

(A) a casket surround including a bottom, side walls, end walls, a lid movable between a raised open position and a lowered closed position in which it defines a predetermined clearance height within said surround, and means mounting one of said end walls for pivotal movement between open and closed positions;

(B) a burial vault, including a base and a removable dome lid, said lid having a height that represents a substantial portion of the total height of the vault, said vault having a total vertical height with said dome vault lid in place less than said predetermined clearance height so as to fit within said casket surround with said surround lid in its lowered position; and (C) adjustment means within said casket surround operative to move said vault within said casket surround between a raised position in which at least a portion of the upper edge of said vault base is positioned proximate the upper edges of said side walls and end walls of said surround to facilitate viewing of the corpse in said vault with said dome vault lid removed and a lowered position in which the upper edge of said vault base is positioned substantially below said upper edges of said side walls and end walls of said surround by a distance such that the top of said domed vault lid, with said domed vault lid positioned over said vault base, is below the lowered position of said surround lid so that, following viewing of the corpse, said vault base may be moved to its lowered position, said domed vault lid may be positioned over said vault base and sealed thereto, and said surround lid may be moved to its closed position to totally enclose the sealed vault;

(D) said adjustment means comprising rail means comprising at least one rail extending longitudinally along said bottom between said end walls, said rail means presenting a flat area for supporting said vault within said casket surround, said area being less than one-half the area of said bottom, and actuator means for selectively moving the ends of said rail means adjacent one of said end walls between raised and lowered positions.

5. A casket assembly comprising:

(A) a casket surround including a bottom, side walls, end walls, and a lid movable between a raised, open position and a lowered, closed position in which it defines a predetermined clearance height within said surround;

(B) a burial vault, including a base and a removable lid, having a vertical height with said vault lid in place less than said predetermined clearance height so as to fit within said casket surround with said surround lid in its lowered position, and (C) adjustment means within said casket surround operative to move said vault within said casket surround between 1. a raised position in which at least a portion of the upper edge of said vault base is positioned proximate the upper edges of said side walls and end walls of said surround to facilitate viewing of the corpse in said vault with said vault lid removed, and 2. a lowered position in which the upper edge of said vault base is positioned below said upper edges of said side walls and end walls of said surround and the top of said vault lid, with said vault lid positioned over said vault base, is below the lowered position of said surround lid so that, following viewing of the corpse, said vault base may be moved to its lowered position, said vault lid may be positioned over said vault base and sealed thereto, and said surround lid may be moved to its closed position to totally enclose the sealed vault, (D) said adjustment means comprising rail means extending longitudinally along said floor and actuator means for selectively moving the ends of said rail means adjacent one of said end walls between raised and lowered positions;

(E) said one end wall of said casket surround being fixed and said casket assembly further including means mounting the other end wall of said casket surround for movement between a closed position and an open position allowing lengthwise movement of said vault into and out of said casket surround;

(F) said rail means comprising fixed rail means extending along said floor between an outboard end positioned adjacent said movable end wall to an inboard end positioned at an intermediate location along said floor and movable rail means extending along said floor between an inboard end adjacent the inboard end of said fixed rail means and an outboard end positioned adjacent said fixed end wall; and (G) said actuator means including means engaging the outboard ends of said movable rail means and operative to raise said outboard end to pivot said movable rail means upwardly about its inboard end.

6. A casket assembly according to claim 5 wherein:

(I) said actuator means includes threaded means carried by said movable rail means adjacent its outboard end and a screw bolt extending vertically adjacent said fixed end wall for threaded engagement at its lower end with said threaded means and for access at its upper end with a suitable rotating tool.

* * * * *